US005368385A

United States Patent [19]

Adamo et al.

[11] Patent Number: 5,368,385

[45] Date of Patent: Nov. 29, 1994

[54] CONTINUOUS SOLUTION METHOD AND APPARATUS

[75] Inventors: Joseph R. Adamo, Lansdale; Gloria M. Lipovsky, Langhorne; Robert Hecker, Jr., Levittown, all of Pa.; Leon D. Ranalli, Murrells Inlet, S.C.

[73] Assignee: Rohm and Haas Company, Philadelphia, Pa.

[21] Appl. No.: 109,784

[22] Filed: Aug. 20, 1993

[51] Int. Cl.[5] ..... B01F 13/06; B01F 15/02

[52] U.S. Cl. ..... 366/139; 366/165; 366/173

[58] Field of Search ..... 366/150, 165, 167, 172, 366/173, 177, 178, 179, 181, 139

[56] References Cited

U.S. PATENT DOCUMENTS

| | | | |
|---|---|---|---|
| 4,077,612 | 3/1978 | Ricciardi | 366/165 |
| 4,390,284 | 6/1983 | Hyde et al. . | |
| 4,440,711 | 4/1984 | Kwon et al. . | |
| 4,501,828 | 2/1985 | Hadermann et al. . | |
| 4,551,296 | 11/1985 | Kavesh et al. . | |
| 4,640,622 | 2/1987 | Sortwell | 366/167 |
| 4,643,582 | 2/1987 | Ricciardi | 366/165 |
| 4,784,820 | 11/1988 | Kavesh et al. . | |

FOREIGN PATENT DOCUMENTS

| | | |
|---|---|---|
| 183285 | 11/1990 | European Pat. Off. . |
| 8555539 | 12/1985 | Japan . |

*Primary Examiner*—Robert W. Jenkins
*Attorney, Agent, or Firm*—Wendy A. Taylor

[57] ABSTRACT

A method is disclosed for preparing a homogeneous solution of a powder, Particularly hard-to-wet polymer powders, which includes:

(1) feeding simultaneously a powder and a liquid solvent for the powder to a high-speed in-line mixer minimizing contact between said powder and said liquid solvent before said powder and said liquid solvent enter said mixer;

(2) mixing said powder and said liquid solvent in said mixer to form a dispersion of said powder in said liquid solvent; and (3) dissolving said dispersed powder in said solvent.

This invention is also directed to a powder/liquid delivery apparatus which minimizes the contact between a powder stream and a liquid stream, containing:

(1) a column having an upper section and a lower section, said lower section having an interior diameter less than the interior diameter of said upper section, said upper section having an inlet at the top and said lower section having an outlet at the bottom;

(2) a means for feeding a powder stream into said lower section and through said outlet, said powder stream having a diameter less than the diameter of the inner surface of said outlet and said powder stream having a center aligned with the center of said outlet; and (3) a means for evenly feeding liquid downwardly along the inside surface of said lower section and into said outlet.

1 Claim, 2 Drawing Sheets

CONTINUOUS SOLUTION METHOD AND APPARATUS

FIELD OF THE INVENTION

This invention relates to a method and apparatus for continuously preparing a homogeneous solution of powder in liquid, particularly an aqueous solution of hard-to-wet polymer powder.

BACKGROUND OF THE INVENTION

For industrial purposes, it is frequently necessary to rapidly combine streams of liquids and solids to form solutions on a continuous basis. The problems encountered in forming uniform solutions by mixing powdered or granulated solids with liquids have been researched extensively. However, no suitable means for dissolving hard-to-wet materials, such as certain polymers, has previously been discovered to prepare solutions of 5–95% dissolved solids.

Many water soluble polymers, such as polyvinyl alcohol, hydroxyethyl cellulose, carboxymethyl cellulose and the like, are extremely soluble in water but are nevertheless very difficult to dissolve. The polymer particles adhere strongly to one another on wetting and tend to form lumps. In most traditional mixing devices, such lumps become wetted before the particles disperse into individual particles. The wetted surface of a lump becomes an impermeable film that hinders break up of the lump, and the lumps are carried through the mixer with the powder inside remaining substantially dry and unmixed with the liquid.

Another problem encountered in forming solutions of polymer powders is the release of substantial amounts of dust. Depending on the type of material, airborne dust may present health hazards. For example, polymer dust is extremely slippery when wet and thus may present a safety hazard to workers if it forms on surfaces around the mixing device. It may also be a respiratory irritant. The dust may also present a process problem if it accumulates on the interior surfaces of the mixing equipment. If the surfaces are moist but not washed, a wet paste can build up to plug passages of the equipment.

A traditional solution to the problems of preparing solutions of hard-to-wet polymer powders is a batch process. In an example of a traditional method, ambient temperature water is charged to a blend tank, and the water is agitated to form a vortex. The powder is then dispersed in the ambient water by gradually adding it to the vortex. The agitated mixture of powder and water is heated using, for example, steam sparging or jacket heating to a specific cure temperature. The mixture is held and agitated at the cure temperature for the time required to dissolve the powder. Polyvinyl alcohol, for example, is first formed into a slurry in ambient temperature water and then heated to a temperature of at least 90° C. Under these conditions, the complete dissolution of the slurry typically takes 30 to 60 minutes and yields no greater than a 10% solution. Hydroxyethyl cellulose is another hard-to-wet powder which, although curing at ambient temperature, requires at least two hours to form a complete solution.

There are many disadvantages with the traditional method. A fundamental problem is that the method is inefficient, costly, capital intensive and time-consuming. The powder is added to ambient temperature water with high agitation to disperse the powder. If the water is at an elevated temperature, the powder clumps more readily. Once the powder is relatively well dispersed, the mixture must be heated and held at the higher temperature in order to dissolve the polymer. The mixing, heating, and curing cycle is slow. In addition, the space required for the blend tank may present a problem in installing a polymer solution system in an existing plant. Also problematic is that undissolved powder clumps can remain in the solution and result in inconsistent solution properties. Solution aeration due to the high speed agitation required for polymer dispersion and excessive foaming due to the heat-curing requirement are additional problems.

DESCRIPTION OF THE PRIOR ART

Numerous alternative solution methods have been offered to the traditional method. As with the traditional method, many of the alternative solutions use mechanical energy to disperse the solid in the solvent. For example, U.S. Pat. Nos. 4,440,711 and 4,551,296 disclose processes for preparing high-molecular weight polymer solutions in two mixing stages. In the first step of each process, a 2 to 15 weight % solution of a high-molecular weight polymer is formed in a nonvolatile solvent. The solution is prepared using two mixing vessels. In the first mixing vessel, a high-molecular weight polymer is combined with a non-volatile solvent and agitated to form a slurry. More intensive mixing occurs in the second vessel, which is equipped with helical agitator blades in an agitated mixing tank, to convert the slurry into a solution. Generally, the temperature in the second vessel is above 200° C.

U.S. Pat. Nos. 4,784,820 discloses a method for continuously preparing solutions of high molecular weight polymers for extrusion or solution spinning. The first step of the method is to form a slurry of polymer particles in solvent; in the examples, this slurry is formed by mixing a polymer powder and a solvent in an agitated drum. The slurry is pumped to a screw extruder and maintained in the extruder for sufficient time and at a sufficient temperature so as to form a homogeneous polymer solution.

European Patent Application EP 0,183,285 also discloses the use of a screw extruder for this application. It teaches a method for the continuous preparation of homogeneous polymer solutions in which a suspension of a high molecular weight polymer powder and a suitable liquid solvent is processed in a screw extruder at elevated temperatures. The extruder is equipped with alternate mixing and conveying sections used to mix and knead the suspension in order to transform it into a homogeneous solution. The temperature must be above the dissolution temperature of the polymer and below the boiling point of the solvent; generally, a temperature between about 140° C. and 220° C. is used. The speed of rotation is such that mechanical shear rates of between 30 and 2000 seconds$^{-1}$ are achieved.

Other methods use alternatives to mechanical energy to disperse the solid. U.S. Pat. No. 4,501,828 discloses a method for dissolving water soluble polymers in suitable liquid solvents to achieve very high polymer concentrations. Finely divided particulate polymer is mixed with frozen solvent particles at a temperature below the freezing point of the solvent to form a homogeneous blend. As the mixture warms to a temperature above the freezing point of the solvent, the polymer particles dissolve in the melting solvent. Solid solutions containing from less than 25% to as high as 75% polymer can be produced in this manner.

U.S. Pat. No. 4,390,284 discloses a high kinetic energy water spraying apparatus for wetting powdered or granular dry material, particularly hard-to-wet polymers, to provide lump-free solutions containing up to 2% or more particulate material. A volumetric feeder drops the dry material through an upper conical portion of the apparatus into a lower cylindrical portion. The upper portion serves primarily as a receptacle for the dry material. As the material falls through the upper portion and into the lower, there is no substantial contact between the dry material and the liquid. However, the inner surface of the upper portion is completely wetted to prevent buildup of dry material on the surface. Wetting of the bulk of the dry material occurs in the lower portion of the apparatus. The lower portion is a cylindrical column equipped with spray nozzles positioned to produce jets of liquid that are oriented downward and radially inward. As the material falls through the column, it is wetted as it is impinged on by the high energy jets of liquid. The slope of the jets creates a downward air flow so that any dust from the dry material is drawn downward into the column.

Japanese Patent 85-055539 discloses a method of continuously preparing aqueous polyvinyl alcohol solutions. An aqueous suspension of polyvinyl alcohol is formed and fed continuously to a steam jetter. Simultaneously, steam is introduced into the jetter to heat the suspension. From the jetter the suspension is fed to a zone consisting on long pipes and in-line mixers where it is held at elevated temperature and pressure for a specified period of time.

Although the above-described methods offer some improvements over the traditional batch process for preparing solutions of hard-to-wet polymers, none is completely satisfactory. Many of these methods are time consuming and capital intensive. In addition, many of these methods are methods of polymer dissolution, that is, converting a polymer slurry into a polymer solution, and do not solve how to disperse the polymer in the solvent to form the initial slurry. The methods are also limited by the solution concentration that can be achieved, particularly for the range of 5-95% dissolved solids. Furthermore, the methods are limited by the temperature to which the slurry must be subjected.

SUMMARY OF THE INVENTION

This invention is directed to a method for preparing homogeneous solution of a powder in a liquid solvent, including:

(1) feeding simultaneously a powder and a liquid solvent for the powder to a high-intensity in-line mixer minimizing contact between said powder and said liquid solvent before said powder and said liquid solvent enter said mixer;

(2) mixing said powder and said liquid solvent in said mixer to form a dispersion of said powder in said liquid solvent; and (3) dissolving said dispersed powder in said solvent.

This invention is also directed to a powder/liquid delivery apparatus which minimizes the contact between a powder stream and a liquid solvent stream, containing:

(1) a column having an upper section and a lower section, said lower section having an interior diameter less than the interior diameter of said upper section, said upper section having an inlet at the top and said lower section having an outlet at the bottom;

(2) a means for feeding a powder stream into said lower section and through said outlet, said powder stream having a diameter less than the diameter of the inner surface of said outlet and said powder stream having a center aligned with the center of said outlet; and (3) a means for evenly feeding liquid downwardly along the inside surface of said lower section and into said outlet.

DETAILED DESCRIPTION OF THE INVENTION

The present invention is directed to a method for preparing a homogeneous solution of a powder in a liquid and a powder/liquid delivery apparatus. For purposes of discussion, this description will refer to "powder" as the solid material being wetted and dissolved and "liquid" as the solvent for the solid material being wetted and dissolved. It is understood, however, that any similar powdered or granular material can be wetted and formed into a solution using apparatus according to the present invention. Also, the method and apparatus are not only suitable for forming solutions of hard-to-wet powders and granulated materials, such as polymers, but also is capable of efficiently forming solutions and mixtures of more easily wetted materials.

Figure 1:
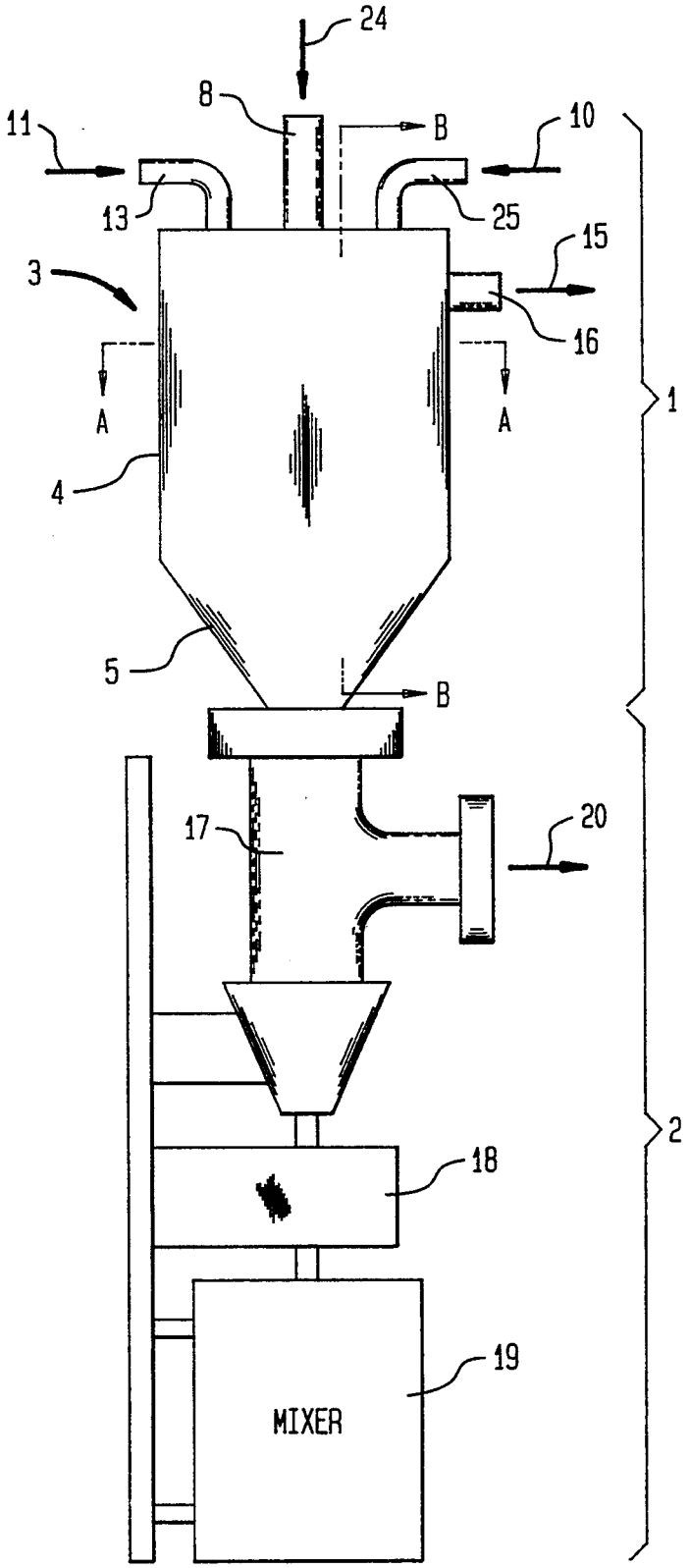
FIG. 1 is a schematic representation of the powder/liquid delivery apparatus connected to a high intensity in-line mixing apparatus.
Figure 2:
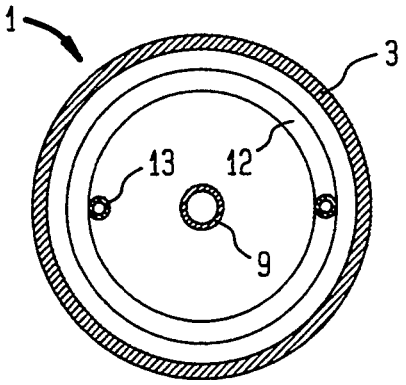
FIG. 2 is a plan view of the powder/liquid delivery apparatus taken along line A—A of FIG. 1.
Figure 3:
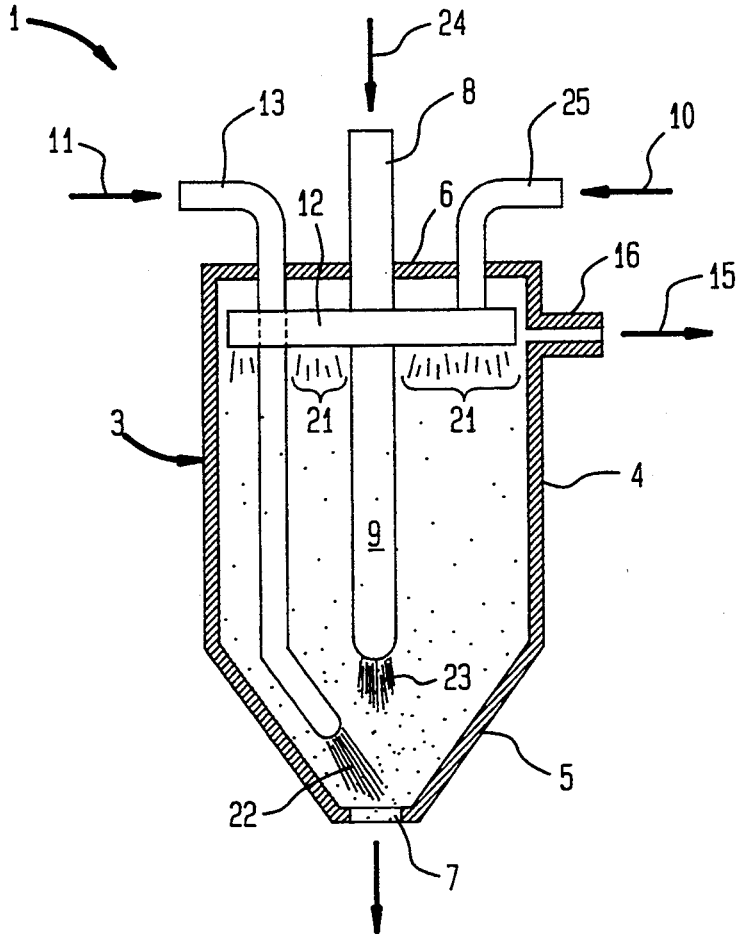
FIG. 3 is an enlarged view of the internal portion of the powder/liquid delivery apparatus taken along line B—B of FIG. 1.

The method of the invention for preparing a homogeneous solution of a powder in a liquid includes at least three steps:

First, a powder and a liquid solvent for the powder are fed simultaneously into a high-intensity in-line mixer minimizing contact between the powder and the liquid solvent before the powder and the liquid solvent enter the mixer. The configuration of the powder/liquid delivery apparatus of the invention, such as the preferred embodiment as shown in FIG. 1, FIG. 2 and FIG. 3, minimizes the contact between the powder stream 20 and the liquid streams 21 and 22. If the powder stream and the liquid streams are in excessive intimate contact as they enter the mixer, clumps will form. The liquid flow, therefore, must be controlled such that no liquid collects in any substantial quantity in the lower section or outlet of the powder/liquid delivery apparatus.

Next, the powder and liquid solvent are mixed to form a solution of the powder in the liquid solvent, if the dissolution is not time-dependent, or a dispersion of the powder in the liquid solvent, if the dissolution is time-dependent. The mixer must mix the powder and liquid solvent and then move the solution or dispersion out of the mixing chamber 16 of the mixer 2 before the dispersion backs up causing excessive contact between the powder stream 20 and the liquid streams 21 and 22 in the powder/liquid delivery apparatus 1.

Finally, the dispersed powder is allowed to dissolve in the liquid solvent, if the dissolution is time-dependent, as the dispersion or solution 19 flows from the mixing chamber 16 and into a storage tank or other processing equipment.

The method of this invention is suitable for forming solutions of hard-to-wet materials of from about 0.1% solids by weight to about 95% solids by weight, preferably from about 5% solids by weight to about 30% solids by weight. Typical hard-to-wet materials include polyvinyl alcohol, hydroxyethyl cellulose, carboxymethyl cellulose and the like.

Powder/Liquid Delivery Apparatus

The apparatus of the present invention is best understood with reference to the drawings. FIG. 1 illustrates schematically a first embodiment of the invention which includes a powder/liquid delivery apparatus 1 positioned above a high-intensity in-line mixer 2. The powder/liquid delivery apparatus and high-intensity in-liner mixer are made of conventional materials, such as, for example, metal, ceramic or plastic, limited only by the particular application for which the apparatus and mixer are used. For example, a plastic material may not be utilized if the liquid is a solvent for the plastic material as well as the powder being wetted and dissolved.

The powder/liquid delivery apparatus 1 is a continuous, low residence time contactor where gravity provides the main driving force for flow of the materials through the contactor. Additional mixing occurs downstream in the high intensity in-line mixer 2. The powder/liquid delivery apparatus of the invention contains at least three parts and is best understood with further reference to the FIG. 2 and FIG. 3.

The first part of the powder/liquid delivery apparatus 1 is a column 3 having an upper section 4 and a lower section 5. The lower section 5 has an interior diameter less than the interior diameter of the upper section. The upper section 4 has an inlet 6 at the top and the lower section 5 having an outlet 7 at the bottom. Preferably, the lower section 5 is tapered toward the outlet. More preferably, the lower section 5 is conically-shaped. Preferably, the upper section 4 is cylindrically-shaped.

The second part of the powder/liquid delivery apparatus 1 is a means for feeding a powder stream into the lower section 5 and through the outlet 7. The resulting powder stream 23 must have a diameter less than the diameter of the inner surface of the outlet 7 and have its center aligned with the center of outlet 7.

In FIG. 3, the powder is fed continuously into the powder/liquid delivery apparatus 1 through a narrow diameter hollow cylinder 8 which is aligned with the center of the outlet 7 of the lower section 5 of the powder/liquid delivery apparatus 1 and having a diameter less than the diameter of the inner surface of the outlet 7. The opening at the end of shaft 9 is positioned such that it delivers a stream of powder 23 at a level lower than the first source of liquid 10 and higher than the second source of liquid 11. Preferably, the opening at the end of shaft 9 is positioned such that it delivers a stream of powder 23 at a level equal to the horizontal plane where the upper section 4 and lower section intersect 5.

The third part of the powder/liquid delivery apparatus 1 is a means for evenly feeding liquid at any temperature downwardly along the inside surface of the lower section 5 and into the outlet 7. The flow of the liquid-feeding means must be such that no liquid collects in any substantial quantity in the lower section 5 or outlet 7 of the powder/liquid delivery apparatus 1.

In FIG. 3, a liquid is fed continuously into the powder/liquid delivery apparatus 1 through two sources 10 and 11. The first source 10 provides a continuous stream of liquid 21 which contacts the inner surface of the upper section 4 of the powder/liquid delivery apparatus 1, supplied by a narrow diameter hollow cylinder 25, in the form of a sparge ring 12 having a plurality of holes and encircling the inside surface of the upper section 4 of the powder/liquid delivery apparatus 1. Preferably, the sparge ring 12 provides a mist of the liquid 21 which deposits on and moves uniformly down the inner surface of the upper section 4 the powder/liquid delivery apparatus 1 of the powder/liquid delivery apparatus the powder/liquid delivery apparatus 1. The second source provides a stream of liquid through a narrow diameter hollow cylinder 13 positioned such that it delivers a stream of liquid 22 into the lower portion of the lower section 5 of the powder/liquid delivery apparatus 1. It is preferred that at about 90% of the liquid flow be channeled through the second source 11.

Preferably, the powder/liquid delivery apparatus 1 contains a means for pulling vacuum 15 on the inside of the column 3, especially under conditions when the liquid solvent is volatile or utilized at an elevated temperature. A means for pulling vacuum removes any gaseous material before it wets the free-falling powder and beneficially cools the powder/liquid delivery apparatus. The vacuum pulling means may be house vacuum, such as for example through a shaft 16, pulling vacuum from 1 inch mercury to 10 inch mercury. The vacuum-pulling means preferably located as high as possible above the liquid-feeding and powder-feeding means.

Preferably, the internal surfaces of the powder/liquid delivery apparatus are coated with a non-stick coating, such as tetrafluoroethylene fluorocarbon polymers, fluorinated ethylenepropylene resins, and the like.

High-Intensity In-Line Mixer

The method of the invention utilizes any high-intensity in-line mixer. In FIG. 1, the high-intensity in-line mixer 2 is attached to the outlet 7 of the powder/liquid delivery apparatus 1. The high-intensity in-line mixer 2 generally contains a mixing chamber 17 where the powder stream 23 and liquid streams 21 and 22 are mixed, a gear drive 18 and a motor 19. Preferably, the high-intensity in-line mixer 2 has multi-staged mixing zones. The degree of dispersion of the powder in the liquid and final dissolution of the powder in the liquid is increased with each successive stage. Suitable mixing heads which provide multistaged mixing zones include tandem shear turbine/stator configurations.

The following examples illustrate specific aspects and particular embodiments of the invention which, however, in not to be construed as limited thereby.

EXAMPLE 1.

Preparation of Homogeneous Solutions of Polyvinyl Alcohol

The following types of polyvinyl alcohol were utilized to demonstate that the method of the invention and the powder/liquid delivery system are useful for forming homogeneous solutions of a hard-to-wet powder:

| Polyvinyl Alcohol Grade | Source | Relative Molecular Weight | Degree of Hydrolysis | Temperature (°C.) |
|---|---|---|---|---|
| VINOL 205-S | Air Products | low | 87–89% (partially-hydrolyzed) | ambient |
| ELVANOL 71-30 | DuPont | low | 99+% (fully hydrolyzed) | 90 |
| VINOL 540-S | Air Products | high | 87–89% (partially hydrolyzed) | ambient |

The apparatus of the claimed invention as described in FIGS. 1–3 was utilized to form homogeneous solutions of polyvinyl alcohol without any time necessary for curing. Undissolved powder clumps were not present in the solutions formed for any of the three polyvinyl alcohol samples. Dust did not accumulate to any appreciable extent.

EXAMPLE 2.

Preparation of Homogeneous Solutions of Hydroxyethyl Cellulose

Cellosize QP-3L hydroxyethyl cellulose from Union Carbide was utilized to demonstate that the method of the invention and the powder/liquid delivery system are useful for forming a homogeneous solution of a hard-to-wet and hard-to-dissolve powder.

The apparatus of the claimed invention as described in FIGS. 1–3 was utilized to form homogeneous solutions of hydroxyethyl cellulose without any time necessary for curing at 80°–85° C. Undissolved powder clumps were not present in the solutions formed for any of the three hydroxyethyl cellulose samples. Dust did not accumulate to any appreciable extent.

We claim:

1. A powder/liquid delivery apparatus, comprising:

(1) a column having an upper section and a lower section, said lower section having an interior diameter less the interior diameter of said upper section, said section having an inlet at the top and cylindrically-shaped and said lower section having an outlet at the bottom and conically-shaped;

(2) a means for feeding a powder stream into said lower section and through said outlet, said powder stream having a diameter less than the diameter of the inner surface of said outlet and said powder stream having a center aligned with the center of said outlet;

a means for evenly feeding liquid downwardly along the inside surface of said lower section and into said outlet, comprising:

(a) a narrow diameter hollow cylinder discharging a first stream of liquid into said lower section along the inside surface of said column, below the discharge of said powder feeding means and above said outlet; and (b) a sparge ring having a plurality of holes and encircling the inside surface of said inlet, discharging a second stream of liquid along the inside surface of said column and into said outlet; and (4) a means for pulling vacuum on the inside of said column.

* * * * *